United States Patent [19]

Schulte et al.

[11] 4,148,850

[45] Apr. 10, 1979

[54] SUPPORTING STRUCTURE FOR LARGE NATURAL DRAFT COOLING TOWER

[75] Inventors: Hugo Schulte; Wolfgang Müller, both of Ratingen; Jörg Schlaich, Kernen; Günter Mayr, Stuttgart, all of Fed. Rep. of Germany

[73] Assignee: Balke-Dürr Aktiengesellschaft, Ratingen, Fed. Rep. of Germany

[21] Appl. No.: 874,813

[22] Filed: Feb. 3, 1978

Related U.S. Application Data

[63] Continuation of Ser. No. 303,150, Nov. 2, 1972, abandoned.

[30] Foreign Application Priority Data

Nov. 5, 1971 [DE] Fed. Rep. of Germany ..... 2154967
Sep. 1, 1972 [DE] Fed. Rep. of Germany ..... 2243222

[51] Int. Cl.[2] ..... B01F 3/04

[52] U.S. Cl. ..... 261/109; 52/80; 52/83; 52/222; 52/224; 52/248; 261/DIG. 11; 261/DIG. 77

[58] Field of Search ..... 261/109, 111, DIG. 11, 261/DIG. 77, 140 R; 52/80, 83, 222, 224, 245, 246, 248

[56] References Cited

U.S. PATENT DOCUMENTS

| | | | |
|---|---|---|---|
| 1,098,004 | 5/1914 | Alberger | 261/DIG. 11 |
| 3,034,606 | 5/1962 | Wiegand | 52/83 X |
| 3,243,166 | 3/1966 | Osenga et al. | 261/DIG. 11 |
| 3,300,942 | 1/1967 | Horstman | 261/DIG. 11 |
| 3,304,351 | 2/1967 | Sweeney | 52/224 X |
| 3,422,883 | 1/1969 | Daltry | 261/140 R X |
| 3,562,986 | 2/1971 | Nelson et al. | 52/246 |
| 3,613,322 | 10/1971 | Czarnecki, Sr. | 52/83 |
| 3,637,193 | 1/1972 | Kugler et al. | 261/111 X |
| 3,780,999 | 12/1973 | Fordyce | 261/DIG. 11 |

FOREIGN PATENT DOCUMENTS

| | | | |
|---|---|---|---|
| 586020 | 10/1933 | Fed. Rep. of Germany | 261/DIG. 11 |
| 2154530 | 2/1973 | Fed. Rep. of Germany | 261/DIG. 11 |
| 689805 | 4/1953 | United Kingdom | 261/DIG. 11 |
| 1013285 | 12/1965 | United Kingdom | 261/DIG. 11 |
| 1183193 | 3/1970 | United Kingdom | 261/DIG. 11 |

*Primary Examiner*—Richard L. Chiesa
*Attorney, Agent, or Firm*—Joseph A. Geiger

[57] ABSTRACT

Supporting structure for a large natural draft cooling tower consisting of a central tower support in the form of a hollow column of reinforced concrete and hyperboloid-shaped cooling tower mantle supported by the central tower support with the aid of cables and tie rings at the top and bottom of the cooling tower mantle. The upper tie ring is suspended from the top of the central tower support by means of a series of inclined supporting cables and the lower tie ring is connected to the upper tie ring by means of two sets of oppositely diagonally inclined mantle supporting cables, under a downwardly directed preload, forming a hyperboloid-shaped cable grid. To this grid are attached the section panels of the cooling tower mantle. The cable preload is provided by means of holding cables extending between the lower tie ring and a series of ground anchors, or by means of the diagonally inclined cables themselves which may be attached to the ground anchors. The mantle supporting cables may include a third set of cables in a meridian arrangement or in a concentric circular arrangement. The inclined supporting cables of the upper tie ring carry wind deflector rings.

14 Claims, 6 Drawing Figures

SUPPORTING STRUCTURE FOR LARGE NATURAL DRAFT COOLING TOWER

CROSS-REFERENCE TO RELATED APPLICATION

This application is a continuation of our co-pending application Ser. No. 303,150, filed Nov. 2, 1972, now abandoned.

BACKGROUND OF THE INVENTION

1. Field of the Invention

The present invention relates to structures for natural draft cooling towers and, more particularly, to a lightweight supporting structure for a large natural draft cooling tower having a hyperboloid-shaped mantle.

2. Description of the Prior Art

The known cooling tower structures represent several different approaches to the problem of erecting a large vertical shell. One such approach features a steel structure consisting of straight structural steel profiles with flared portions which envelop the mantle area of the cooling tower, thereby creating a tower framework of hyperbolic outline. The mantle of the cooling tower consists of planks of wood or some other suitable material. This type of framework structure, using steel profiles as the only support, is comparatively costly as an investment and has the additional disadvantage that it requires considerable maintenance expense. Consequently, this approach has not prevailed, particularly in the case of larger cooling tower structures.

Other approaches to the construction of large cooling tower shells involve the use of reinforced concrete. One such approach provides for the cooling tower mantle to be cast with the aid of a mantle form which is being shifted in either a slip mode or a climbing mode or a rotational mode. Reinforcing irons are embedded in the mantle wall as the form is shifted from section to section.

Another known cooling tower structure (U.S. Pat. No. 3,304,351) requires the erection of a temporary scaffolding and the use of steel cables which are connected to the upper end of the scaffolding and tensioned downwardly against a ring beam which is to form the lower extremity of the cooling tower shell. The cables are oppositely diagonally inclined and tied together with circular tension rings, so as to form a hyperboloid-shaped cable network. The concrete mixture which is to form the cooling tower mantle is applied against this cable network in a spraying procedure. Once the concrete mantle is in place and hardened, the cables are released from the upper beams of the scaffolding and the latter is removed. The initial cable tension then becomes a compressive tension on the concrete shell, giving the cooling tower mantle its necessary stability and resistance.

The described concrete cooling tower structures are subject to high construction costs, due primarily to the complexity of the required scaffolding and concrete forms. An additional shortcoming relates to the fact that the available opening between the ground and the bottom edge of the cooling tower mantle, for reasons of static stability, cannot exceed a certain vertical distance. This is particularly undesirable in the case of very large cooling tower structures, the resultant limitation of the inlet cross section for the cooling air creating problems with respect to an even distribution of the cooling air over the cross-sectional area inside the cooling tower.

In the field of ventilator cooling towers, where tower dimensions are much smaller than the dimensions of natural draft cooling towers, there has been suggested a shell structure consisting of a cable grid to which the mantle is attached like a skin, using suitable lightweight mantle panels (U.S. Pat. No. 3,637,193). Circular spoked rings at the upper extremity and in the midportion of smallest cross section determine the shape of the cooling tower mantle, the spoked rings being fixedly connected to a central column which thereby carries the weight of the cooling tower mantle.

An important shortcoming of the described cablesupported structure is that its tensioning cables have to be angled off at the midportion of smallest diameter to such an extent that it becomes necessary to tension the cables separately in two length sections. In the conical upper section of the cooling tower, the cables need to be tensioned between the spoked ring on the exit extremity of the cooling tower and the spoked ring in the smallest-diameter midportion, thereby creating tensile forces in the cables which subject the spoked rings to vertical bending moments. In order to convert these bending moments into compressive forces which can be counteracted by the spokes of the two rings, it is necessary to arrange the spokes in an inclined radial orientation, the spokes coinciding with the surface of an imaginary cone. It has been found that these spokes need to be of very large cross section, especially in the case of large cooling towers, in order to sustain the combined stress which results from the cable forces and from the weight of the spoked ring and of the spokes themselves, given the considerable distance between the mantle and the central column. Numerous large spokes of this type, on the other hand, create a noticeable resistance to the flow of cooling air which, in turn, means a correspondingly higher power consumption of the ventilator or, in the case of a natural draft cooling tower, necessitates an increase in the height of the latter. Lastly, the spokes have a tendency to create a certain flow turbulence in the cooling air, resulting in an operating noise of considerable noise level.

SUMMARY OF THE INVENTION

Underlying the present invention is the primary objective of providing a novel approach to the construction of a natural draft cooling tower, free of the above-mentioned structural and operational shortcomings and disadvantages, the proposed tower being very simple in its overall structure and economical in its construction requirements, using simple structural components which are subjected to a predetermined controllable stress, while offering complete freedom in the adaptation of the dimensions of the intake opening to the specific requirements of any cooling tower installation.

The present invention proposes to attain this objective by suggesting a novel structure for a natural draft cooling tower featuring a central tower support that extends upwardly beyond the upper tie ring at the exit extremity of the cooling tower mantle, the upper tie ring being suspended from the central tower support by means of a series of inclined supporting cables which extend downwardly and radially outwardly from the top of the central tower support.

The cooling tower structure of the invention, when compared with known cooling tower structures, proves to be considerably simpler and correspondingly less costly in construction, because both the tensioning cables in the mantle-supporting cable grid and the inclined supporting cables of the upper tie ring are subjected to purely tensile forces which are transmitted to the top of the central tower support. Apart from the central tower support, there are no structural elements occupying the interior space of the cooling tower, so that the operating costs are lower and the operating noise is minimized. Lastly, the cooling tower structure of the invention makes it possible to arrange the intake extremity of the cooling tower mantle at any desired distance from the ground, so that the size of the intake opening can be chosen at will to obtain an optimal cooling air flow and cooling efficiency, regardless of the size of the cooling tower itself.

An additional advantage of the present invention resides in the fact that it features as a support for the cooling tower mantle a statically stable cable grid in the shape of a body of rotation which is capable of sustaining considerable load conditions, particularly loads which are the result of wind impact, without suffering any appreciable deformation. This result is achieved with a cable grid consisting of two sets of supporting cables extending at a diagonal inclination, one set being inclined to the left side, and the other set being inclined the right side, while a third set of cables is arranged coextensively with the diagonally inclined cables so as to form cable intersections defining a cable network with triangular mesh openings. The invention suggests that the third set of cables be arranged either in the manner of meridian cables which coincide with a vertical plane through the tower axis, or as circular cables which coincide with horizontal transverse planes.

The superiority of this type of cable grid as a load-bearing structure results from the fact that the triangular mesh pattern of the cable grid produces a shift-resistant cable network which, because of its vertical preloading, reacts to static load like a thin shell. The result is not only a reduction in the peak forces acting on the cable grid, but also an absence of deformations of the grid geometry which would otherwise complicate and impede the design and installation of the cooling tower mantle on the supporting cable grid.

The material selected for the cables of the supporting cable grid is metal, preferably steel, in certain cases also high-strength synthetics. It is also possible to use for each cable position more than one, i.e. preferably two, coextensive cables. Using pairs of cables has the additional advantage of greatly facilitating the arrangement of suitable cable clamps at the intersection points of the cable grid, the cable clamps producing rigid intersection knots where the cables of the three cable sets in the grid intersect each other. The use of a third set of cables in the cable grid, while deflecting the diagonally inclined cables away from their straight line, maintains the geometric shape of a body of rotation for the mantle supporting cable grid.

While there is no absolute necessity to provide a tie ring at the lower edge of the cooling tower mantle, such a tie ring at the intake extremity of the cooling tower mantle will, according to the present invention, further stabilize that portion of the mantle shell. The arrangement of such a lower tie ring offers a choice between having the cables of the hyperboloid cable grid extend all the way to the ground, or of having these cables terminate at the lower tie ring and arranging a set of straight holding cables between the lower tie ring and the foundation anchors of the cooling tower shell. The proposed subdivision of the tensioning cables into mantle supporting tensioning cables and separate holding cables—which may be different in number, diameter and orientation from the mantle supporting tensioning cables—makes it possible to choose for the shape of the cooling tower structure in the area of the air intake opening a configuration other than the circular shape of the cooling tower mantle itself. More particularly, it now becomes possible to choose in the area of the air intake a square or rectangular shape of the cooling tower, thereby providing an optimal mounting space for the cooling elements in the cooling tower. The separate foundation sections may be combined to form a unitary foundation ring of the desired outline.

The present invention offers the additional possibility of arranging intermediate tie rings at different levels of the cooling tower mantle, thereby further stabilizing the latter, particularly in the case of an intermediate tie ring which is arranged in the smallest-diameter midportion of the cooling tower. Such an intermediate tie ring may be carried by the vertical cables of the cable grid or, according to a further suggestion of the invention, it may be supported on the central tower support with the aid of a series of inclined supporting cables. The tie rings are preferably composed of a large number of straight ring sections so as to form a multi-cornered polygon, the ratio of the number of holding cables or supporting cables, respectively, to the number of sides on the polygon being preferably an integer ratio.

The proposed cable grid structure, using three intersecting sets of supporting and tensioning cables, subjects the upper tie ring to a compressive preload between the mantle supporting cable grid and the inclined supporting cables above the tie ring. The latter thus fulfills the function of an end disc on a thin shell, thereby preventing virtually all deformation on the upper extremity of the shell and creating an optimal force distribution over the cables of the cable grid. It follows that the maximum shear forces in the area of the lower extremity of the shell are greatly reduced. Additional intermediate tie rings may be arranged at other levels on the cable grid, using similar inclined supporting cables which are connected to the central tower support, thereby further increasing the preload on the tower shell. It is also possible to provide for additional stiffening and support of the cable grid by arranging one or several ring cables on the latter and by tensioning them against the central tower support with inclined cables, thereby providing additional stiffness for the lower edge of the cooling tower mantle.

The present invention further suggests an improvement in the air flow out of the upper end of the cooling tower, in order to enhance the draft action of the rising air and in order to prevent the creation of downwardly oriented air currents caused by eddying at the exit rim of the cooling tower mantle. Such an improved air flow is achieved through the arrangement of at least one deflector ring above the exit opening of the cooling tower mantle, the ring being conveniently carried by the inclined supporting cables of the upper tie ring. In its most simple form, such a deflector ring may have the form of a sleeve, i.e. a short length of a large-diameter drum. It may be advantageous to use several deflector rings in a concentric arrangement, the rings being vertically staggered along the inclination of the tie ring supporting cables. Where it is necessary to achieve a convergence or divergence of the exiting air flow, it is also possible to give the deflector rings a cross-sectional shape which is not a straight thin wall, but which is shaped like an air foil, so as to impart to the air flow the desired guidance and change of direction.

The present invention, by featuring a hollow central tower support, also makes it possible to provide an access way to the top of the tower in the form of a spiral staircase or an elevator at the inside of the central tower support. On the outside of this hollow-cylindrical column may be arranged suitable footing surfaces for a rotatable and vertically movable service crane. The latter can be used as part of the equipment which is needed for the erection of the cooling tower structure, it can also be used to install the cooling elements and, after completion of all assembly operations, it can serve as an access means to the cooling tower mantle, for inspection and maintenance. The spiral staircase at the inside of the central tower support may be constructed in such a way that it will serve to stiffen and reinforce the steel skeleton of the central tower support.

A cooling tower structure of the type suggested by the invention may be used as either a "wet" cooling tower, where a portion of the hot cooling water is evaporated and escapes with the cooling air draft, or as a "dry" cooling tower, where the hot cooling water is circulated through heat exchanger elements which are cooled by the air draft in the cooling tower. The central tower support of the proposed cooling tower structure could also be used to support a ventilator, provided the tower mantle is of a sufficiently small diameter. The cooling tower mantle itself consists preferably of lightweight panels which are attached to the supporting cable grid, the panel material being any suitable material which requires no maintenance over an extended period of time.

Using the approach which is suggested by the present invention, it is also possible to improve cooling tower structures of the type which have a rigid concrete mantle. The provision of an upper tie ring and inclined supporting cables extending from the ring to the top of the central tower support makes it possible to have the latter carry a portion of the load of the tower mantle, so that the supporting columns between the ground and the bottom edge of the cooling tower mantle need not be as massive as in the past and can therefore be taller, for a greater distance between the ground and the intake edge of the cooling tower. The enlarged intake opening means that more air can enter the cooling tower and that, especially in the case of a dry cooling tower, a greater number of heat exchanger elements can be arranged in this area.

While the air flow is thus improved at the inlet of the cooling tower, it is also improved at the outlet end of the cooling tower shell, through the arrangement of the proposed air deflector rings under the inclined supporting cables of the upper tie ring. Lastly, the proposed use of a central tower support makes it possible to use a thinner concrete shell, thereby giving the latter a considerably higher elasticity, a feature which offers advantages for natural draft cooling towers which are erected in areas that have a potentially unstable ground, as may be the case in earthquake-prone areas or in areas which are slowly sinking due to underground mining or removal of ground water. The greater elasticity of a cooling tower shell as proposed by the invention also gives it a considerably higher resistance to dynamic forces, especially wind pressure, than is the case with a cooling tower mantle of the massive concrete design.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows.

DESCRIPTION OF THE PREFERRED EMBODIMENTS

Figure 1:
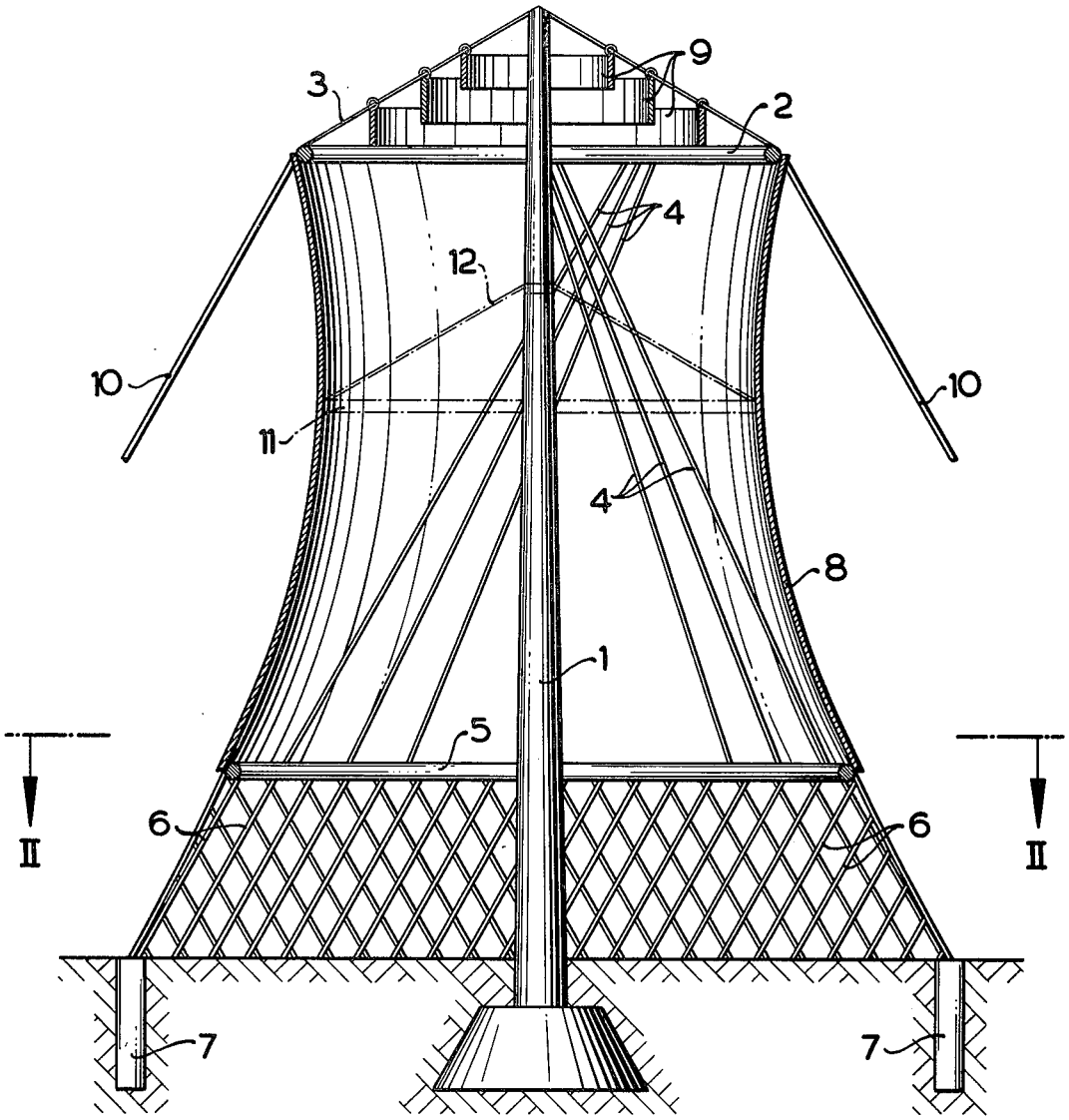
FIG. 1 is a schematic representation of a natural draft cooling tower structure embodying the invention, the tower being shown in a vertical cross section.
Figure 2:
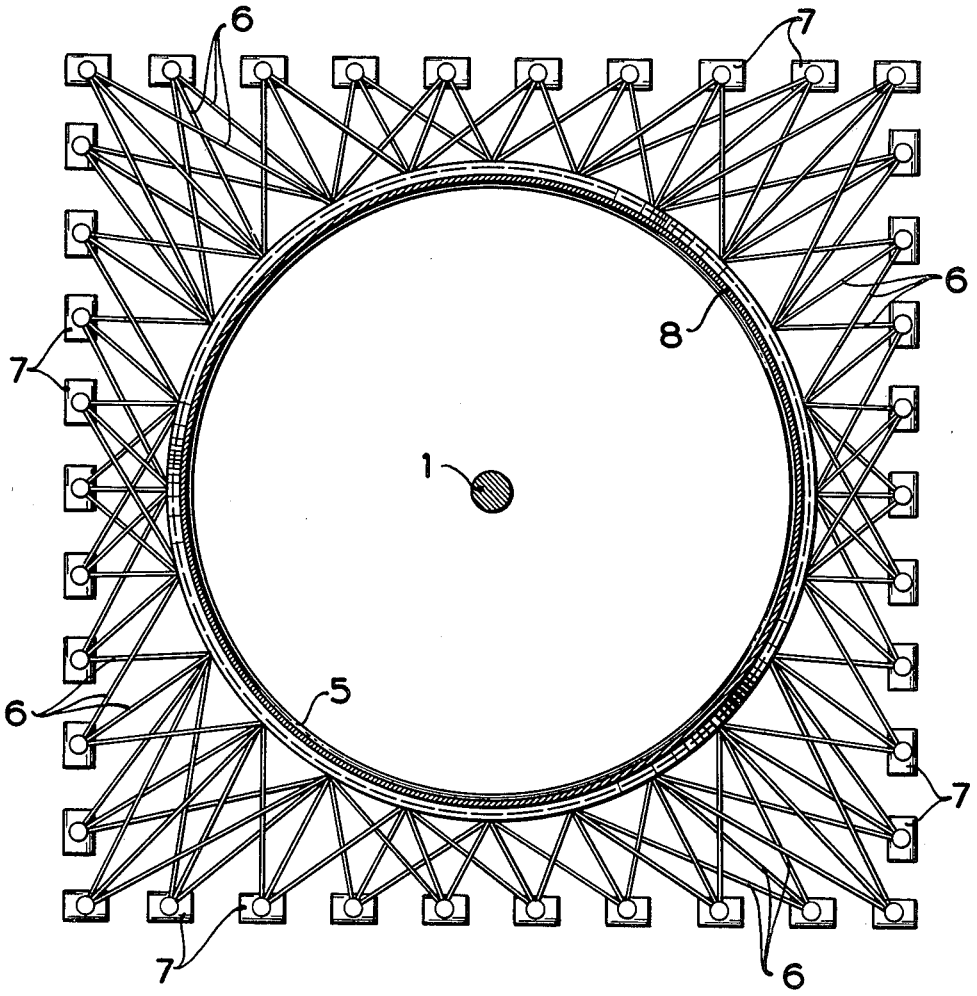
FIG. 2 shows the cooling tower structure of FIG. 1, in a cross section taken along line II of FIG. 1.

A first embodiment of the invention, as shown in FIGS. 1 and 2, features a central tower support 1 carrying an upper tie ring 2, at a distance below the top of the central tower support 1, with the aid of a series of inclined supporting cables 3 extending downwardly and radially outwardly from the top of the central tower support 1. The upper tie ring 2 has attached to it the upper extremities of a cable grid consisting of a series of straight tensioning cables 4, the lower extremities of which are attached to a lower tie ring 5. Alternatively, the tensioning cables 4 may extend all the way to the foundation of the cooling tower. The tensioning cables 4 consist of two sets of oppositely diagonally inclined cables which thereby define the outline of a hyperboloid-shaped body of rotation.

In the embodiment shown, the cable grid formed by the tensioning cables 4 is anchored to the ground by means of holding cables 6 which extend in straight lines between the lower tie ring 5 and the separate foundation sections 7. As shown in FIG. 2, the foundation sections 7 are located along the outline of a square, so that the area available for the arrangement of the heat exchanger elements is likewise square, while the cross section of the cooling tower shell itself is circular.

The cable grid constituted by the tensioning cables 4 between the upper tie ring 2 and the lower tie ring 5 carries a cooling tower mantle 8 of any suitable lightweight material. The mantle 8 consists preferably of a large number of panels. The panel material may be plastic, asbestos cement, foamed plastic, plastic sheet, or concrete.

To the inclined supporting cables 3 which carry the upper tie ring 2 are connected three deflector rings 9 which guide the rising warm air vertically upwardly and which also prevent the formation of eddy currents and downwardly directed flows of cold air inside the cooling tower shell, under the influence of side winds. Additional stabilizing cables 10 may be used to increase the stability of the cooling tower structure.

FIG. 2 shows how the holding cables 6 produce a transition from the circular shape of the cooling tower mantle 8 to the square shape of the air inlet opening for the cooling air. FIG. 1 also indicates, in stippled lines, how an intermediate tie ring 11 could be provided at the smallest-diameter midportion of the cooling tower mantle 8, thereby stabilizing the tensioning cables 4 of the cable grid. The intermediate tie ring 11 may be connected to the central tower support 1 by means of inclined intermediate supporting cables 12.

Figure 3:
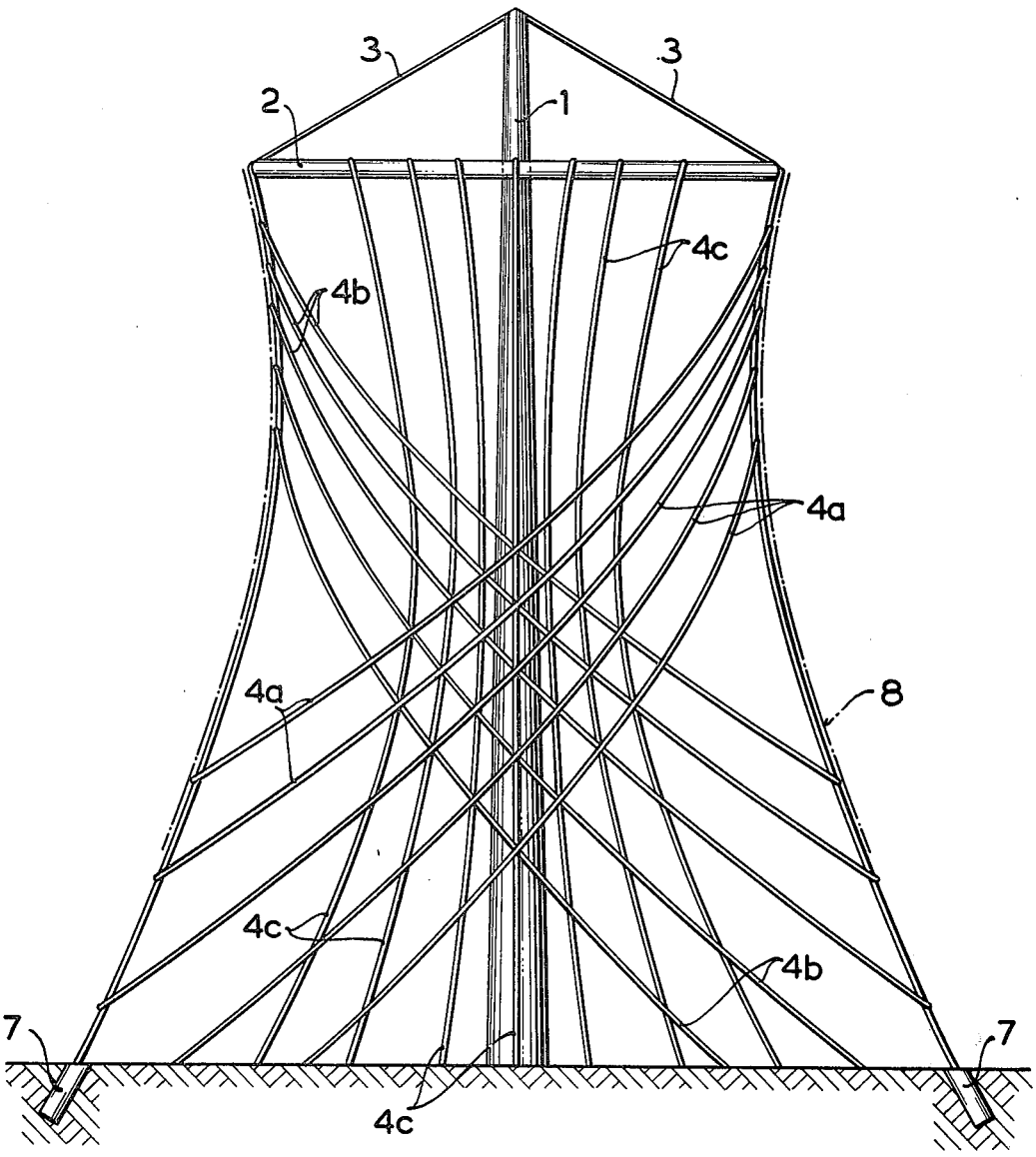
FIG. 3 is a schematic elevational view of a natural draft cooling tower representing a second embodiment of the invention.
Figure 4:
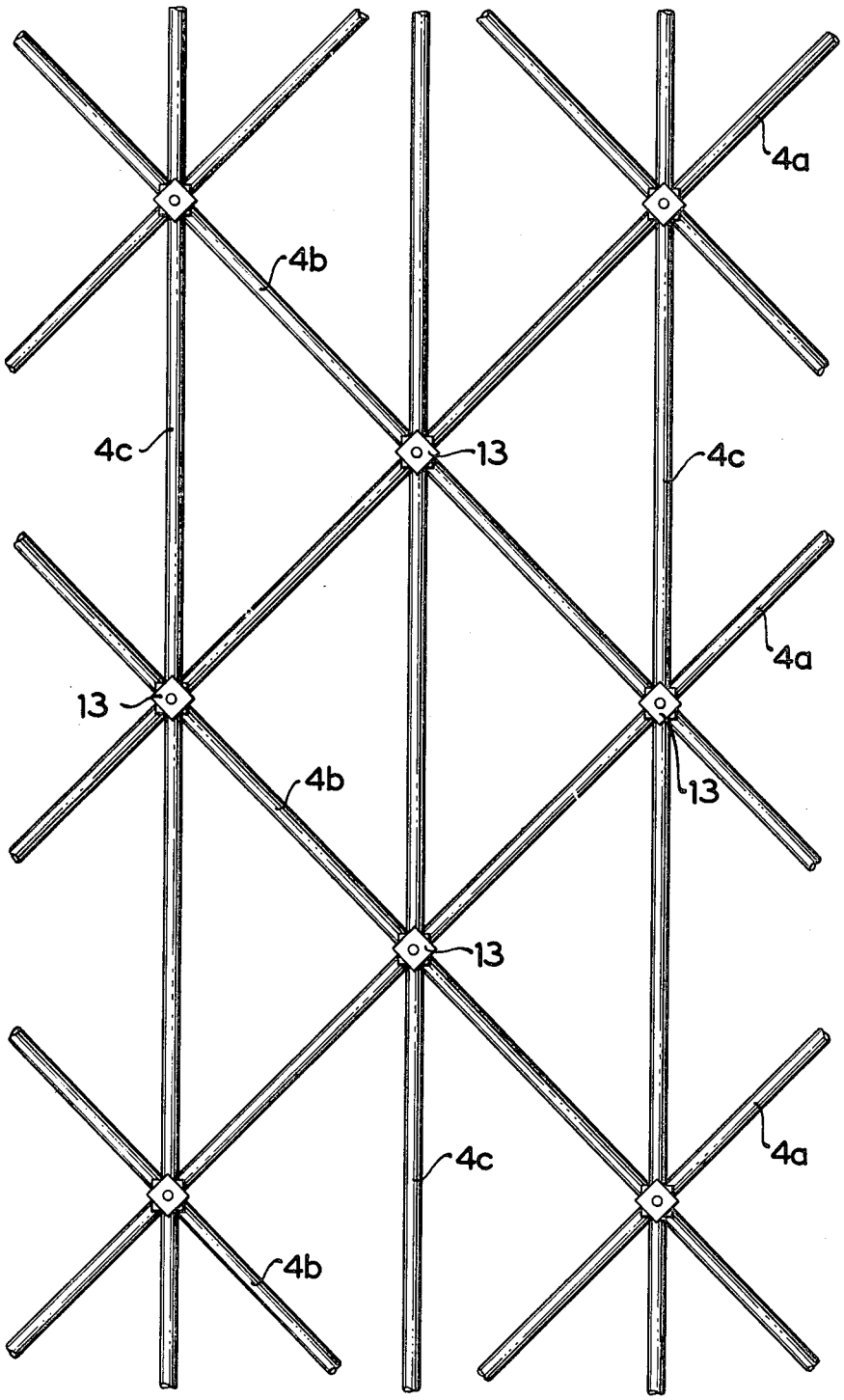
FIG. 4 shows a typical portion of the cable grid of the cooling tower structure of FIG. 3, at an enlarged scale.
Figure 5:
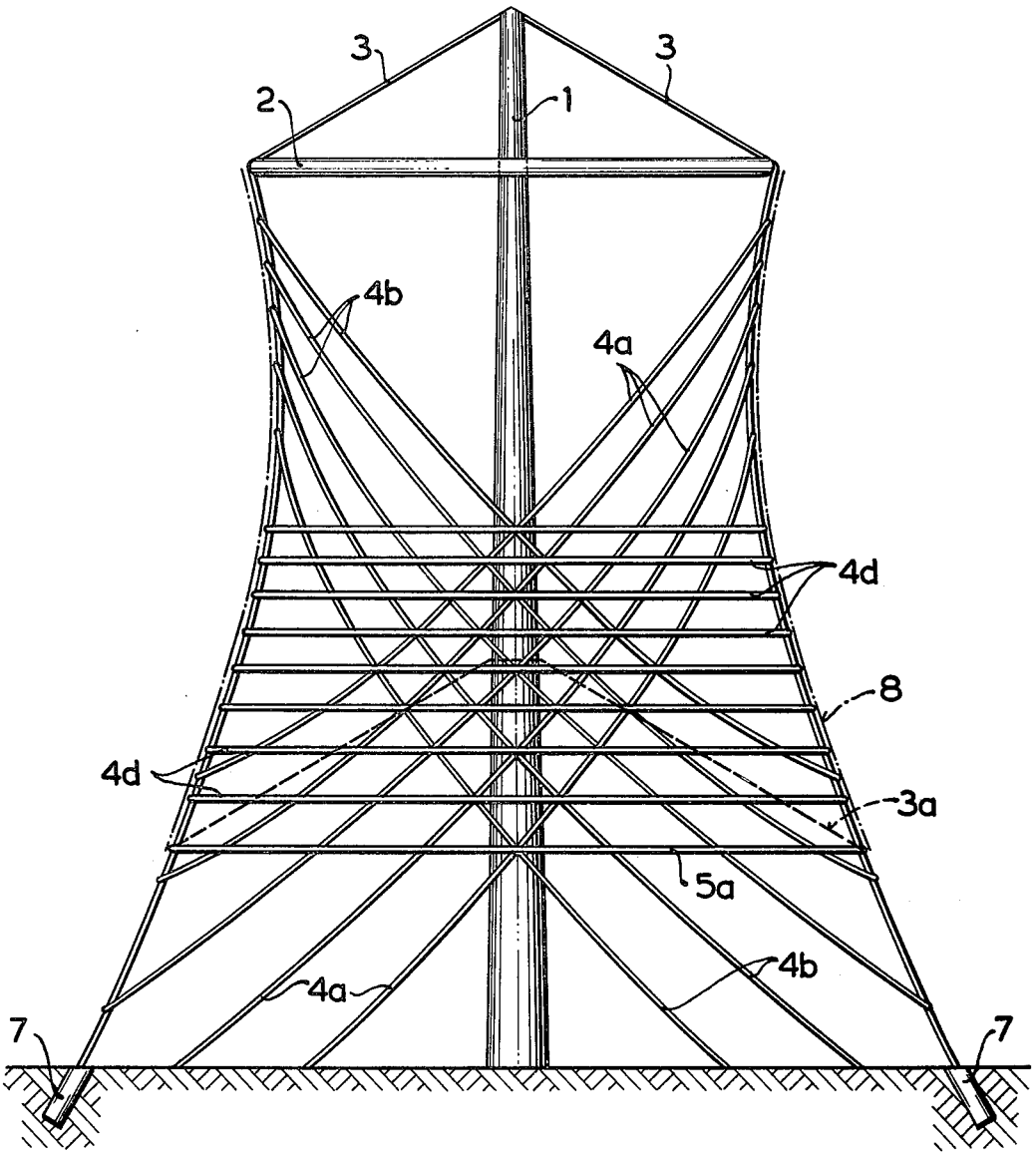
FIG. 5 is a schematic elevational view of a natural draft cooling tower representing a third embodiment of the invention.
Figure 6:
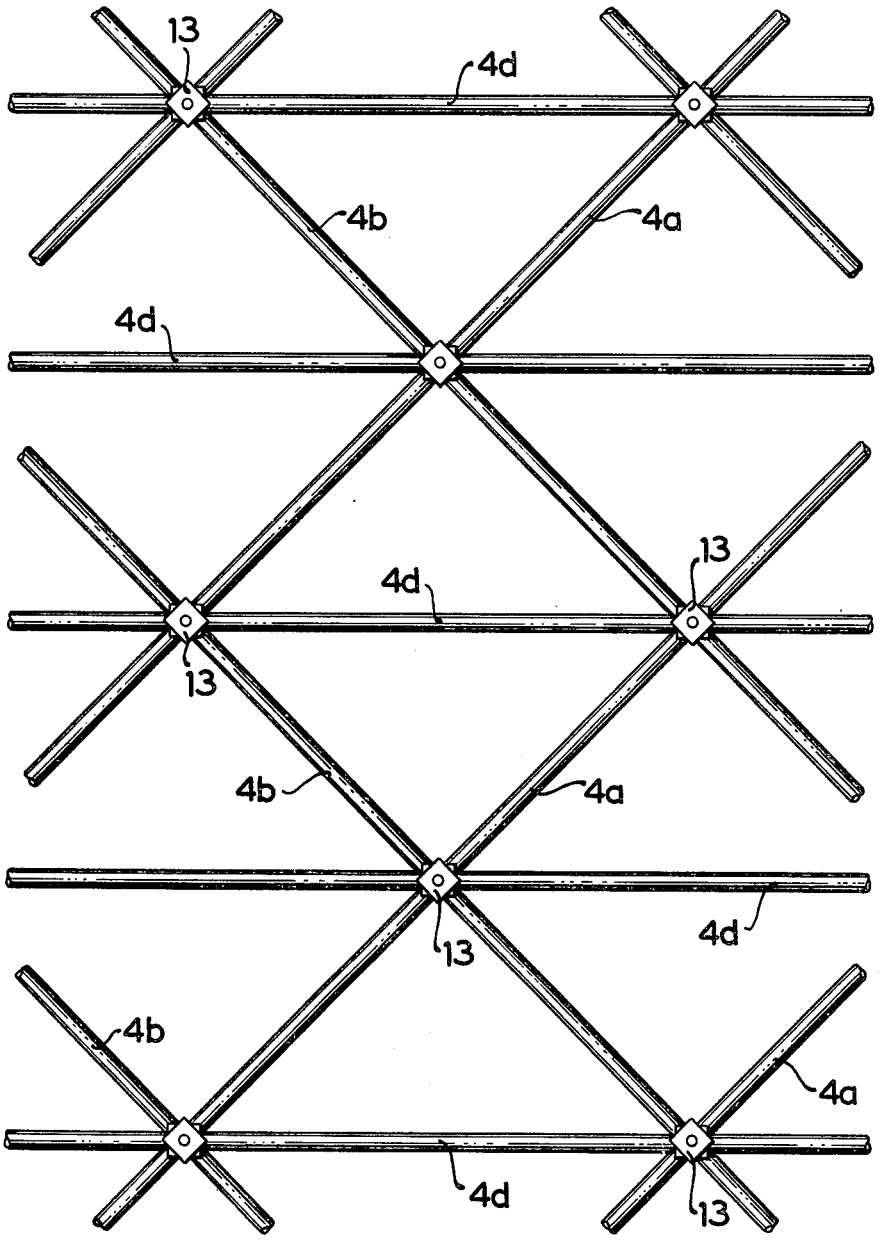
FIG. 6 shows a typical portion of a cable grid of the cooling tower structure of FIG. 5, at an enlarged scale.

Two additional embodiments of the invention are shown in FIGS. 3 and 4 and in FIGS. 5 and 6, respectively, the cable grid of these embodiments consisting in each case of three sets of supporting and tensioning cables which extend all the way from the upper tie ring 2 to the cable-anchoring foundation 7.

In the embodiment of FIGS. 3 and 4, the cable grid consists of a first set of right-hand ascending diagonal cables 4*a*, and a coextensive second set of left-hand ascending diagonal cables 4*b*, as well as a likewise coextensive third set of meridian cables 4*c* extending upwardly in vertical planes through the cooling tower axis. The meridian cables 4*c* intersect the diagonal cables 4*a* and 4*b* at the intersection points 13 of the latter (FIG. 4), thereby defining a cable lattice pattern with triangular mesh openings. The three sets of cables are attached to each other at the intersection points 13.

The third embodiment of the invention, shown in FIGS. 5 and 6, features a similar cable grid with triangular mesh openings, defined by three sets of tensioning and supporting cables. The inclined diagonal cables 4*a* and 4*b*, instead of being preloaded outwardly by the meridian cables, are here preloaded inwardly by a series of circular cables 4*d* which are arranged in vertically spaced horizontal planes. The three sets of cables are again coextensive and attached to each other at the points of intersection 13 (FIG. 6).

The inclined diagonal cables 4*a* and 4*b* of the three embodiments are in each case of uniform length, being inclined by the same angle, but in the opposite sense, from the vertical direction. While the diagonal cables of the embodiment of FIG. 1 extend along straight lines, thereby defining an exactly hyperboloid-shaped body, the diagonal cables 4*a* and 4*b* of the embodiment of FIG. 3 are slightly curved outwardly, under the tensioning effect of the meridian cables 4*c*. Conversely, the diagonal cables 4*a* and 4*b* of the embodiment of FIG. 5 are slightly curved inwardly, under the tensioning effect of the circular cables 4*d*. Like the diagonal cables, the meridian cables 4*c* are all of uniform length. The ring cables 4*d*, however, are of unequal length as is evident from FIG. 5.

The use of three sets of coextensive tensioning and supporting cables, as proposed in the second and third embodiments of the invention, creates a hyperboloid cable grid with a triangular mesh pattern which is comparable in its stress behavior to a thin shell, provided the three sets of cables are firmly attached to each other at their points of intersection 13. Additional cables which, for purposes of assembly or static support, may extend intermediate the points of intersection of the triangular mesh cable grid, are without influence on the stress behavior of the cable grid.

In FIG. 5 is further shown how the lowermost circular cable can serve as a lower end ring 5*a* which is connected to the central tower support 1 by means of inclined supporting cables 3*a*. This arrangement provides a supplemental support for the cable grid and also serves to reinforce the cable grid at the bottom extremity of the cooling tower mantle 8. The latter is not shown in FIG. 3 and FIG. 5, but its position is implied by a stippled line. The cooling tower mantle consists of a series of mantle panels, preferably of aluminum or plastic material.

It should be understood, of course, that the foregoing disclosure describes only preferred embodiments of the invention and that it is intended to cover all changes and modifications of these examples of the invention which fall within the scope of the appended claims.

We claim the following:

1. A cooling tower structure for natural draft cooling tower installations, the structure comprising in combination:

a foundation serving as a footing for the cooling tower;

a vertical central tower support anchored in the tower foundation and capable of carrying the weight of the entire cooling tower structure;

an upper horizontal tie ring concentrically surrounding the central tower support at a distance below its top end;

a first series of supporting cables arranged in a circle and extending radially and obliquely upwardly from the upper tie ring to a point near said top end of the central tower support, thereby supporting said tie ring;

a second series of supporting cables extending downwardly from the upper tie ring in a hyperboloid latticework arrangement, in which a first set of said cables are diagonally inclined in relation to the tower support axis, so as to define a first hyperboloid-shaped cable grid of right-hand-helical appearance, and a second set of said cables are oppositely diagonally inclined so as to define a second, coextensive cable grid of left-hand-helical appearance;

means connected to said two diagonal cable grids for tensioning the latter downwardly against the tower foundation, thereby exerting a substantial downwardly directed pre-load on said hyperboloid-shaped cable grids; and a hyperboloid-shaped cooling tower mantle having a substantially airtight light-weight wall coextensively attached to said two diagonal cable grids; said mantle being thus suspended from the central tower support via said first and second series of supporting cables and said upper tie ring; the upper and lower ends of the tower mantle being open for an upward air flow therethrough; and the lower mantle end being spaced a distance from the cooling tower footing to provide an inlet for said air flow.

2. A cooling tower structure as defined in claim 1, further comprising a lower horizontal tie ring concentrically surrounding the central tower support near the lower end of the tower mantle, said tie ring being connected to the second series of supporting cables.

3. A cooling tower structure as defined in claim 2, further comprising a third series of supporting cables arranged in a circle and extending from the lower tie ring radially and obliquely upwardly toward the tower support.

4. A cooling tower structure as defined in claim 2, wherein:

said second series of supporting cables extends between the upper tie ring and the lower tie ring; and said cable tensioning means includes a series of holding cables extending between the lower tie ring and the tower foundation.

5. A cooling tower structure as defined in claim 4, wherein:

the tower foundation includes cable anchors along a substantially square outline, while said lower tie ring is circular in shape; and said holding cables of the cable tensioning means extend between said circular tie ring and said squarely arranged cable anchors, at accordingly varying angles of cable inclination.

6. A cooling tower structure as defined in claim 2, further comprising an intermediate horizontal tie ring concentrically surrounding the central tower support at an intermediate level between said upper and lower tie rings, said intermediate tie ring being likewise connected to the second series of supporting cables and including means for tying it to the tower support.

7. A cooling tower structure as defined in claim 2, wherein:

the upper and lower tie rings are polygonal in shape, each comprising a plurality of straight tie ring elements; and the ratio between the number of tie ring elements in a tie ring and the number of supporting cables attached to the tie ring is an integer ratio.

8. A cooling tower structure as defined in claim 1, wherein:

the tower foundation includes a series of cable anchors: and the lower cable ends of said two sets of diagonal supporting cables are attached to said cable anchors.

9. A cooling tower structure as defined in claim 8, wherein:

said second series of supporting cables includes, as a third set of cables, a set of meridian cables, each cable extending between the upper tie ring and a cable anchor substantially in alignment with a center plane through the tower support axis, said third set of cables defining a third coextensive cable grid;

the meridian cables are positioned in alignment with cable intersections of said first and second diagonal cable grids, thereby creating triple cable intersections; and the three cable strands of each triple cable intersection are fixedly attached to one another, thereby preventing any shifting of the three cable grids relative to one another.

10. A cooling tower structure as defined in claim 9, wherein the number of meridian cables in the meridian cable grid is identical to the sum of diagonal cables contained in the two diagonal cable grids; the three coextensive supporting cable grids thus defining a latticework composed of triangular mesh units.

11. A cooling tower structure as defined in claim 1, wherein:

said second series of supporting cables includes, as a third set of cables, a set of ring cables, forming concentric horizontal rings vertically spaced from one another so as to define a third coextensive cable grid;

the ring cables are positioned vertically in alignment with cable intersections of said first and second diagonal cable grids, thereby creating triple cable intersections; and the three cable strands of each triple cable intersection are fixedly attached to one another, thereby preventing any shifting of the three cable grids relative to one another.

12. A cooling tower structure as defined in claim 11, wherein the vertical spacing between adjacent ring cables is the same as the spacing of successive cable intersections of the two diagonal cable grids, the three coextensive supporting cable grids thus defining a latticework composed of triangular mesh units.

13. A cooling tower structure as defined in claim 1, further comprising at least one wind deflector ring surrounding the central tower support above the upper tie ring, the deflector ring having the shape of a short, thin-walled tube section of a diameter which is smaller than the diameter of the tie ring; the deflector ring being connected to said first series of supporting cables.

14. A cooling tower structure as defined in claim 13, wherein:

several concentric wind deflector rings of progressively smaller diameter are arranged around the central tower support above the upper tie ring, thereby creating annular air flow guides therebetween;

the upper extremities of the deflector rings are attached to said first series of obliquely upwardly extending supporting cables, so that the deflector rings are carried by said cables and their upper end portions present an upwardly and inwardly staggered succession of deflecting surfaces to any cross wind.

* * * * *